US010450690B2

(12) United States Patent
Bae et al.

(10) Patent No.: US 10,450,690 B2
(45) Date of Patent: Oct. 22, 2019

(54) METHOD OF CONTROLLING WASHING MACHINE

(71) Applicant: LG ELECTRONICS INC., Seoul (KR)

(72) Inventors: Suncheol Bae, Seoul (KR); Youngbin Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/692,853

(22) Filed: Aug. 31, 2017

(65) Prior Publication Data

US 2018/0057991 A1 Mar. 1, 2018

(30) Foreign Application Priority Data

Sep. 1, 2016 (KR) ..... 10-2016-0112546

(51) Int. Cl.

| | |
|---|---|
| ***D06F 33/02*** | (2006.01) |
| ***D06F 35/00*** | (2006.01) |
| ***D06F 37/12*** | (2006.01) |
| ***D06F 37/30*** | (2006.01) |
| ***D06F 37/36*** | (2006.01) |

(52) U.S. Cl.

CPC ..... *D06F 37/304* (2013.01); *D06F 33/02* (2013.01); *D06F 37/12* (2013.01); *D06F 37/36* (2013.01); *D06F 35/008* (2013.01); *D06F 2202/065* (2013.01); *D06F 2202/08* (2013.01); *D06F 2204/065* (2013.01); *D06F 2222/00* (2013.01)

(58) Field of Classification Search

CPC ..... D06F 33/02; D06F 35/008; D06F 37/12; D06F 37/304; D06F 37/36; D06F 2202/065; D06F 2202/08; D06F 2204/065; D06F 2222/00

USPC ..... 8/158, 159; 68/12.01, 12.02, 12.04, 68/12.05, 12.06, 12.14, 12.19, 12.23

See application file for complete search history.

(56) References Cited

U.S. PATENT DOCUMENTS

2011/0061172 A1 3/2011 Koo et al.

FOREIGN PATENT DOCUMENTS

| | | |
|---|---|---|
| DE | 102009046454 | 5/2011 |
| EP | 2381026 | 10/2011 |
| EP | 2725129 | 4/2014 |
| WO | 20110054761 | 5/2011 |
| WO | 20120089628 | 7/2012 |

OTHER PUBLICATIONS

Extended European Search Report in European Application No. 17188820.9, dated Jan. 5, 2018, 10 pages.

*Primary Examiner* — Levon J Shahinian

(74) *Attorney, Agent, or Firm* — Fish & Richardson P.C.

(57) ABSTRACT

A method for controlling a washing machine configured to receive laundry and including a tub and a drum located in the tub includes rotating the drum at a water supply revolutions per minute (RPM), supplying wash water to the tub based on rotating the drum at the water supply RPM, accelerating rotation of the drum based on supplying wash water to the tub, sensing a first eccentric value of the drum based on accelerating the rotation of the drum, based on the first eccentric value, determining a rotational speed for rotating the drum, and rotating the drum at the rotational speed.

20 Claims, 5 Drawing Sheets

METHOD OF CONTROLLING WASHING MACHINE

CROSS REFERENCE TO RELATED APPLICATIONS

This application claims the benefit of Korean Patent Application No. 10-2016-0112546, filed on Sep. 1, 2016, which is hereby incorporated by reference as if fully set forth herein.

FIELD

The present disclosure relates to a method of controlling a washing machine, and more particularly to a method of controlling a washing machine that is capable of cleaning a tub.

BACKGROUND

A washing machine is an apparatus that can remove contaminants from laundry such as clothes through a process of washing the laundry.

The washing machine may be classified into a top loading type washing machine in which the axis of rotation of a drum is perpendicular to the ground, and a front loading type washing machine in which the axis of rotation of a drum is parallel to the ground.

In the top loading type washing machine where the axis of rotation of the drum is substantially perpendicular to the ground, the drum may be provided in a tub that can store wash water, and washing may be performed in a pulsator mode where laundry is washed in a state in which the laundry is immersed in wash water supplied into the drum.

In the pulsator mode, washing may be performed by friction between wash water and laundry and by action of detergent through the rotation of the drum or the rotation of a pulsator that is provided in the lower part of the drum to generate a stream of water. In the pulsator mode, however, washing may be performed only when the wash water is supplied such that the laundry is immersed in the wash water. As a result, a large amount of wash water may be used for washing.

In the front loading type washing machine where the axis of rotation of the drum is substantially parallel to the ground, washing may be performed in a drum washing mode, in which washing is performed by friction between the drum that is rotated by driving force from a motor and laundry and by dropping movement of the laundry in a state in which detergent, wash water, and the laundry are received in the drum.

In the drum washing mode, the laundry may be little damaged, may not become tangled, and may be washed in a striking and rubbing fashion.

In a drum washing machine, which performs washing in the drum washing mode, the axis of rotation of the drum is substantially parallel to the ground. As a result, a portion of the drum may be immersed in wash water even when a small amount of wash water is provided in a tub and the drum. Washing may be performed by friction between the drum that is rotated and laundry and by dropping movement of the laundry in the drum.

Although the tub is not driven, when the drum is rotated at a high speed, wash water may be distributed not only to the lower part of the tub but also to an inner circumferential surface of the tub. In some cases, contaminants or scales may accumulate on the entirety of the inner circumferential surface of the tub. For example, once contaminants or scales accumulate on the inside surface of a door or the upper part of the inner circumferential surface of the tub and are dried, it may be not easy to remove the contaminants or scales therefrom since they are not immersed in wash water.

In some examples of a conventional drum washing mode, a predetermined amount of wash water may be supplied into the tub, and the drum may be accelerated to a specific rotational speed such that the wash water cleans the inner circumferential surface of the tub while it circulates along the inner circumferential surface of the tub according to the rotation of the drum.

In some cases of the conventional drum washing mode, if an eccentric amount of the drum exceeds a reference eccentric amount at a step of accelerating the drum to a specific rotational speed, the drum is decelerated to 0 RPM or a very low rotation speed, and then a subsequent cycle is performed. That is, if the eccentric amount of the drum exceeds a reference eccentric amount at the acceleration step for cleaning the tub, the cleaning of the tub may be skipped. As a result, a success rate of tub cleaning is reduced.

In the conventional drum washing mode, the drum may be rotated at a high speed with water that is suppled after laundry is removed from the drum. Because the supplied water is discharged without being used in a subsequent step, the water may be wasted.

In some examples, detergent may be used for tub cleaning. The detergent for tub cleaning may contain a large amount of chemical components that may cause water pollution. Although the detergent for tub cleaning may have powerful washing force than detergent for washing laundry, it may not be environmentally friendly.

SUMMARY

The present disclosure is directed to a method of controlling a washing machine that can resolve one or more problems of the related art.

One object of the present disclosure is to provide a method of controlling a washing machine that enables wash water to easily clean a tub while circulating along the inner circumferential surface of the tub.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

According to one aspect of the subject matter described in this application, a method for controlling a washing machine configured to receive laundry and including a tub and a drum located in the tub includes rotating the drum at a water supply revolutions per minute (RPM), supplying wash water to the tub based on rotating the drum at the water supply RPM, accelerating rotation of the drum based on supplying wash water to the tub, sensing a first eccentric value of the drum based on accelerating the rotation of the drum, based on the first eccentric value, determining a rotational speed for rotating the drum, and rotating the drum at the rotational speed.

Implementations according to this aspect may include one or more of following features. For example, determining the rotational speed for rotating the drum may include setting the rotational speed of the drum to a first RPM based on the first eccentric value exceeding a reference eccentric value, and setting the rotational speed of the drum to a second RPM greater than the first RPM based on the first eccentric value being less than or equal to the reference eccentric value. Rotating the drum at the rotational speed may include rotating the drum at the first RPM or the second RPM. In some examples, the first RPM may a rate greater than the water supply RPM and less than a resonance frequency of the washing machine. The second RPM may be a rate greater than the resonance frequency of the washing machine.

In some implementations, the method may further include sensing a second eccentric value of the drum based on rotating the drum at the first RPM and stopping rotation of the drum at the first RPM based on the second eccentric value of the drum exceeding the reference eccentric value. In some examples, the method may further include sensing an initial eccentric value based on rotating the drum at the water supply RPM, and determining the rotational speed based on the initial eccentric value. In this case, accelerating the rotation of the drum may include accelerating the rotation of the drum based on the initial eccentric value.

In some implementations, the method may further include performing a spin-drying step that includes accelerating, before supplying the wash water, rotation of the drum to a dry RPM greater than the water supply RPM, and decelerating rotation of the drum from the dry RPM to the water supply RPM based on finishing the spin-drying step. Rotating the drum at the water supply RPM may include rotating the drum at a minimum RPM, in which the laundry maintains contact with an inner circumferential surface of the drum based on the laundry rotating together with the drum at the minimum RPM.

In some examples, supplying the wash water to the tub may include supplying the wash water to the tub to a predetermined water level based on a drainage pump connected to the tub being turned off. Rotating the drum at the rotational speed may include rotating the drum based on the drainage pump being turned off. The predetermined water level may be greater than or equal to a water level defined between a lower end of the tub and a lower end of the drum. An inner circumferential surface of the tub may be cleaned by the wash water that is circulated along the inner circumferential surface of the tub by a rotational force of the drum based on the drum rotating at the rotational speed.

According to another aspect, a method of controlling a washing machine configured to receive laundry and including a tub and a drum located in the tub includes rotating the drum at a water supply RPM, supplying wash water to the tub based on rotating the drum at the water supply RPM, accelerating rotation of the drum based on supplying the wash water to the tub, sensing a first eccentric value of the drum based on accelerating the rotation of the drum, based on the first eccentric value exceeding a reference eccentric value, rotating the drum at a first RPM, and based on the first eccentric value being less than or equal to the reference eccentric value, rotating the drum at a second RPM greater than the first RPM.

Implementations according to this aspect may include one or more of following features. For example, the first RPM may be a rate greater than the water supply RPM and less than a resonance frequency of the washing machine, and the second RPM may be a rate greater than the resonance frequency of the washing machine. In some implementations, the method may further include sensing an initial eccentric value based on rotating the drum at the water supply RPM, based on the initial eccentric value exceeding the reference eccentric value, rotating the drum at the first RPM, and based on the initial eccentric value being less than or equal to the reference eccentric value, rotating the drum at the second RPM. In this case, accelerating the rotation of the drum may include accelerating the rotation of the drum based on the initial eccentric value.

In some implementations, the method may further include performing a spin-drying step that includes accelerating, before supplying the wash water, rotation of the drum to a dry RPM greater than the water supply RPM to thereby remove moisture from the laundry in the drum, and decelerating rotation of the drum from the drying RPM to the water supply RPM based on finishing the spin-drying step. An inner circumferential surface of the tub may be cleaned by the wash water that is circulated along the inner circumferential surface of the tub by a rotational force of the drum. In some examples, the first RPM may be a rate between 130 and 150 revolutions per minute, and the second RPM may be a rate between 150 and 180 revolutions per minute. The dry RPM may be a rate greater than the first RPM and the second RPM.

It is to be understood that both the foregoing general description and the following detailed description of the present disclosure are exemplary and explanatory and are intended to provide further explanation of the present disclosure as claimed.

BRIEF DESCRIPTION OF THE DRAWINGS

The accompanying drawings, which are included to provide a further understanding of the present disclosure and are incorporated in and constitute a part of this application, illustrate implementation(s) of the present disclosure and together with the description serve to explain the principle of the present disclosure.

DETAILED DESCRIPTION

Hereinafter, a washing machine and a method of cleaning a tub of the washing machine according to various implementations will be described in detail with reference to the accompanying drawings. The following implementations are illustrative for understanding of the disclosure, and it should be noted that the present disclosure can be variously modified in manners different from the implementations described herein. In the following description of the present disclosure, however, a detailed description of known functions or configurations incorporated herein may be to make the subject matter of the present disclosure clear. Also, in the accompanying drawings, the size of some elements may be exaggerated than its actual scale to promote understanding of the disclosure.

Although the terms "first" and "second" may be used herein to describe various components, these components are not to be limited by these terms. These terms may be used to distinguish one component from another component.

In some examples, the terminology used in the present application is for the purpose of describing particular implementations only and is not intended to limit the scope of right of the disclosure. The singular form is intended to include the plural form as well, unless the context clearly indicates otherwise. In the present application, it will be further understood that the terms such as "comprises," or "includes," etc. specify the presence of stated features, integers, steps, operations, elements, components, or combinations thereof, but do not preclude the presence or addition of one or more other features, integers, steps, operations, elements, components, or combinations thereof.

Figure 1:
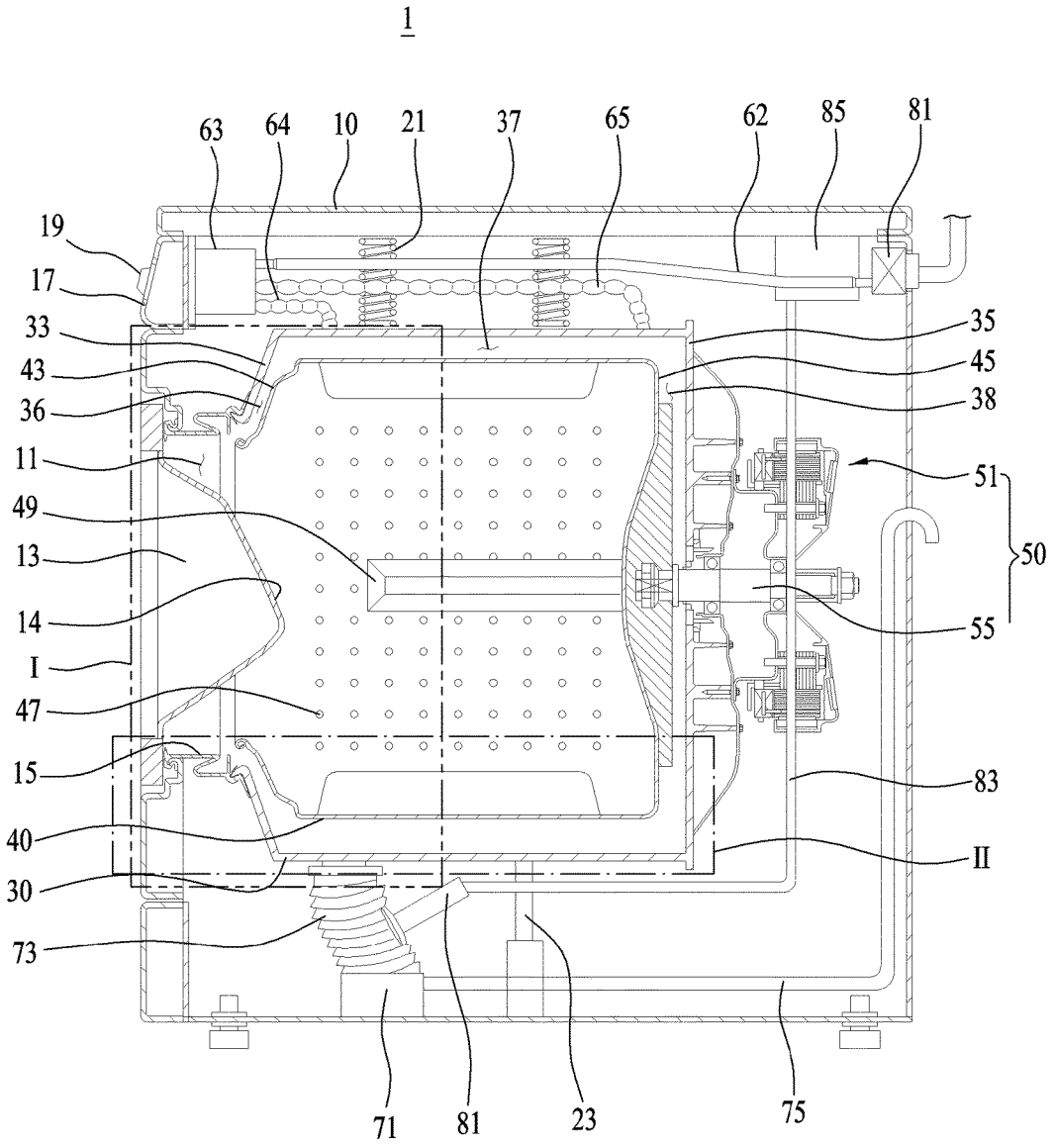
FIG. 1 is a sectional view schematically showing an example washing machine.

FIG. 1 is a sectional view schematically showing example structure of an example washing machine.

Referring to FIG. 1, the example washing machine 1 may include a cabinet 10 having a laundry introduction port 11 formed in the front thereof, a door 13 mounted to the laundry introduction port 11 of the cabinet 10 for opening and closing the laundry introduction port 11, a tub 30 mounted in the cabinet 10 for storing wash water, a driving unit 50 including a motor 51 mounted to the tub 30 for generating driving force and a shaft 55 connected to the motor 51, a drum 40 connected to the shaft 55 for washing laundry using the driving force from the motor 51, a water supply unit 60 for supplying water containing detergent or clean water containing no detergent into the tub 30, and a control panel 17 including an input unit 19 for allowing a user to input various control commands and a display unit for displaying the operational state of the washing machine.

Wash water refers to wash water for washing and cleaning water for cleaning a gasket 15, the door 13, the tub 30, and the drum 40.

FIG. 1 illustrates a direct connection type driving structure in which the motor 51 is directly connected to the shaft 55 in order to drive the drum 40. However, the present disclosure is not limited thereto. In some examples, the control panel 17 is shown as provided at the front of the cabinet 10. However, the present disclosure is not limited thereto.

The cabinet 10 may define the external appearance of the washing machine 1, and the door 14 may be hingedly connected to the front of the cabinet 10 and selectively open or close the laundry introduction port 11. For example, the user may open the door 13 to put laundry in the drum 40 or remove the laundry from the drum 40.

The inside surface 14 of the door 13 that faces the drum 40 may protrude toward the drum 40. When the user pushes the door 13 to close the door, laundry is washed while being contained in the drum 40 in which a portion of the inside surface of the door is located inside the drum 40. The laundry may not be discharged outside the drum 40 during the rotation of the drum 40.

The tub 30 may be provided in the cabinet 10 and receive wash water. Wash water from an external water supply source may be supplied into the tub 30. In some examples, the tub 30 is formed in an approximately cylindrical shape, and may be defined by the circumferential surface and opposite ends thereof. The front end of the tub 30 defines the front surface 33 of the tub 30, and the rear end of the tub 30 defines the rear surface 35 of the tub 30. The tub 30 is provided in the front surface 33 thereof with a front opening, which is formed at a position corresponding to the laundry introduction port 11 of the cabinet 10 such that the inside and the outside of the drum 40 communicate with each other through the front opening.

The circumferential surface of tub 30 is elastically supported by a spring 21 and a damper 23 mounted inside the cabinet 10. In some examples, the tub 30 cannot rotate because the circumferential surface of tub 30 is directly supported by the spring 21 and the damper 23. In this case, rotational force from the motor 51 may not be transmitted to the tub 30 while the drum 40 is driven by the rotation force.

The water supply unit 60 may be provided at the upper side of the tub 30. The water supply unit 60 includes a water supply valve 61 for controlling the flow of clean water supplied through an external hose, a water supply hose 62 for guiding the water that has passed through the water supply valve 61, a detergent supply device 63 for mixing the water that has passed through the water supply hose 62 with detergent and discharging the mixture, and a water supply pipe, having one end connected to the discharge port of the detergent supply device 63 and the other end connected to the upper part of the tub 30, for guiding water containing detergent or clean water containing no detergent, discharged from the detergent supply device 63, into the tub 30.

As shown in FIG. 1, the water supply pipe may include a first water supply pipe 64 and a second water supply pipe 65. In other examples, the water supply pipe may be a single pipe.

The first water supply pipe 64 and the second water supply pipe 65 may be spaced apart from each other in the longitudinal direction of the tub 30. For example, the first water supply pipe 64 and the second water supply pipe 65 may be disposed at a position corresponding to a frequently contaminated portion of the inner circumferential surface of the tub 30 or the outer circumferential surface of the drum 40 such that wash water is directly sprayed to the frequently contaminated portion of the inner circumferential surface of the tub 30 or the outer circumferential surface of the drum 40. In some examples, the first water supply pipe 64 and the second water supply pipe 65 may be bellows pipes, which can prevent vibration from the tub 30 from being transmitted to the detergent supply device 63.

In some implementations, the water supply pipe is described as being a single pipe or as including a first water supply pipe 64 and a second water supply pipe 65. However, the present disclosure is not limited thereto. A various number of water supply pipes may be additionally disposed depending on the contamination pattern of the tub 30 or the drum 40.

In some examples, a drainage device for draining water may be provided at the lower side of the tub 30. The drainage device includes a drainage pump 71 for providing power necessary to discharge the wash water from the tub 30, a first drainage pipe 73 that has one end connected to the lower side of the tub and the other end connected to the drainage pump 71 and guides the wash water from the tub 30 to the drainage pump 71, and a second drainage pipe 75 that has one end connected to the drainage pump 71 and the other end connected to the rear surface of the cabinet 10 and guides the wash water from the drainage pump 71 outside the cabinet 10. The first drainage pipe 73 may be a bellows pipe, which can prevent vibration from the tub 30 from being transmitted to the drainage pump 71.

In some implementations, a water level sensing device may be provided in a space between the cabinet 10 and the tub 30. The water level sensing device may include an air chamber 81 connected to the side surface of the first drainage pipe 73 that is a bellows pipe. The air chamber 81 may be filled with a predetermined amount of air. The water level sensing device may further include a water level sensing tube 83 connected to the air chamber 81. The water level sensing tube 83 may be filled with air transmit pressure. The water level sensing device may further include a pressure sensor 85 connected to the water level sensing tube 83 for sensing the level of wash water based on the pressure transmitted through the air in the water level sensing tube 83. When the water level of the tub 30 increases and thus water pressure increases at the portion of the tub to which the air chamber 81 is connected, the pressure sensor 85 senses the increased water pressure through the air chamber 81 and the water level sensing tube 83, thereby sensing the water level in the tub 30.

The water level sensing device is described as including a pressure sensor 85. However, the present disclosure is not limited thereto. For example, the water level sensing device may include a device such as a flow meter for measuring the quantity of wash water rather than water pressure.

In some implementations, the gasket 15 may be provided between the front of the cabinet 10 and the front opening in the tub 30. The gasket 15 may prevent wash water from being introduced into the gap between the door 13 and the front opening in the tub 30. For instance, the gap between the front of the cabinet 10 and the front opening in the tub 30 is defined by the tub 30 and the cabinet 10 that are spaced apart from each other by a predetermined distance.

The gasket 15 is made of a soft material so as to prevent the vibration of the tub 30, which is caused by the vibration of the motor 51, from being transmitted to the cabinet 10 via the gasket 15. The gasket 15 includes a door side part 151 and a tub side part 152. In FIG. 1, the tub side part 152 is concave. However, the present disclosure is not limited thereto. The tub side part 152 may have various shapes.

The drum 40 may be rotatably provided in the tub 30 and configured to receive laundry. In some examples, the drum 40 may have an approximately cylindrical shape. Like the tub 30, the drum 40 may be defined by the circumferential surface and opposite ends thereof. The front end of the drum 40 defines the front surface 43 of the drum 40, and the rear end of the drum 40 defines the rear surface 45 of the drum 40.

The rear surface 45 of the drum 40 may be directly connected to the shaft 55, which is connected to the motor 51, such that the drum 40 receives rotational force from the motor 51. In some examples, the drum 40 is provided on the inner circumferential surface thereof with lifters 49 for lifting and dropping the laundry or some of the wash water received in the drum 40 when the drum 40 is rotated by the motor 51. When the drum 40 is rotated by the motor 51, the lifters 49 are rotated together with the drum 40 to lift and drop the laundry or some of the wash water on one side surface of the drum 40.

The drum 40 may be provided with a plurality of through holes 47 in the side wall (e.g., the circumferential surface). The drum 40 communicates with the tub 30 via the through holes 47. When a predetermined level of wash water is supplied to the tub 30, the drum 40 is immersed in the wash water that is introduced into the drum via the through holes 47.

Figure 2:
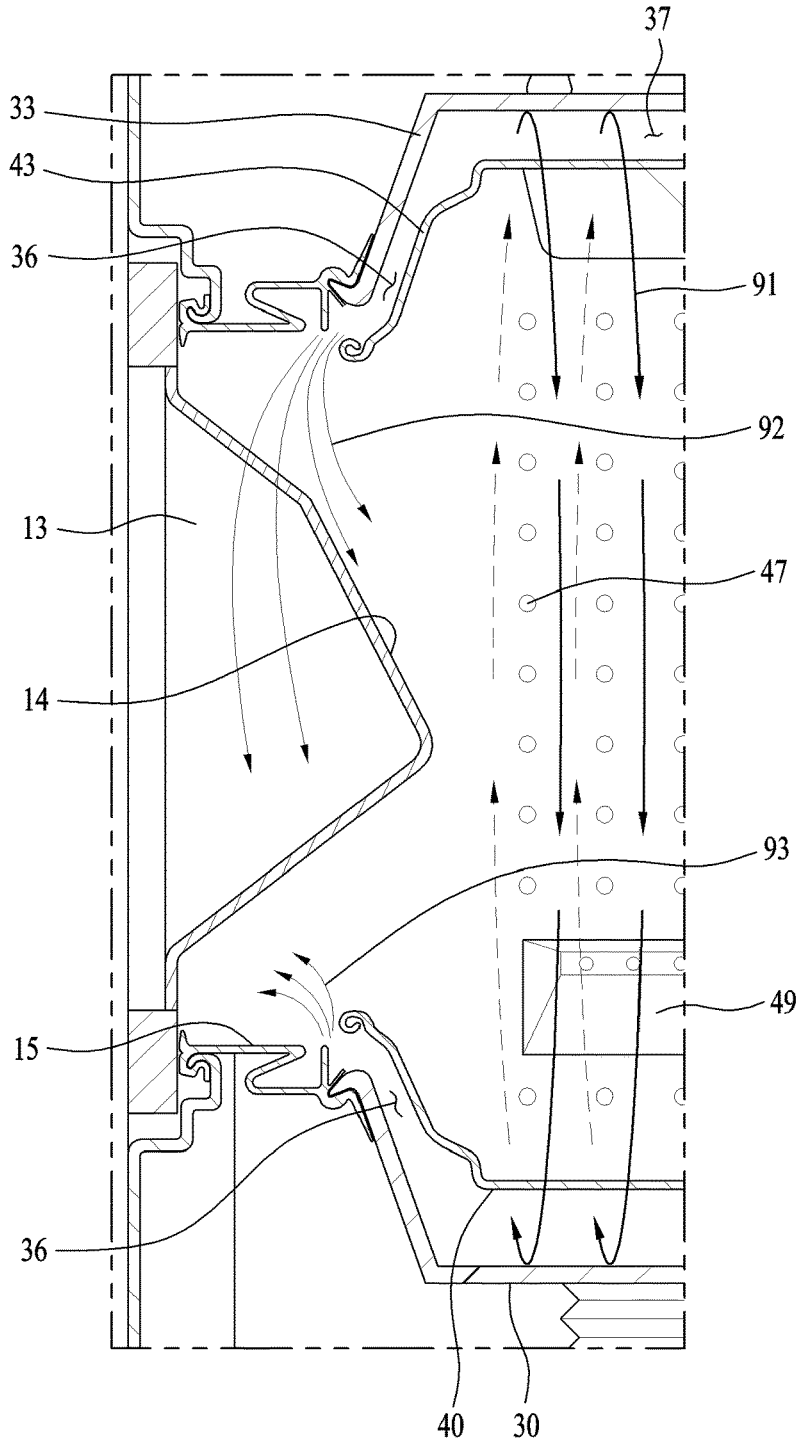
FIG. 2 is an enlarged view showing the part I of FIG. 1 and an example flow of wash water.

An example flow of wash water will be described in detail with reference to FIG. 2. FIG. 2 is an enlarged view showing the part I of FIG. 1 to describe the flow of wash water.

FIG. 2 illustrates an example flow pattern that includes a first flow 91, in which wash water circulates along a tub circumferential gap 37 by the rotational force of the drum 40, a second flow 92, in which wash water drops from the upper part of the front end of the tub 30 (e.g., the upper part of the front surface 33 of the tub 30) through a tub front gap 36, and a third flow 93, in which wash water rises from the lower part of the front end of the tub 30 (e.g., the lower part of the front surface 33 of the tub 30) through the tub front gap 36.

The first flow 91 is an example flow pattern in which wash water may clean the inner circumferential surface of the tub 30 and the outer circumferential surface of the drum 40 while circulating along the inner circumferential surface of the tub 30 and the outer circumferential surface of the drum 40, respectively. Some of the wash water may join the second flow 92 and drop from the upper parts of the front and rear surfaces 33 and 35 of the tub 30.

The second flow 92 is a flow pattern in which wash water rises to the upper part of the front surface 33 or the rear surface 35 of the tub 30 and then drops so as to circulate. Wash water may circulate even when the wash water does not rise to the uppermost part of the tub 30. In some examples, wash water may circulate even when the wash water does not move along the inner circumferential surface of the tub 30. Therefore, the second flow 92 may include the flow of wash water that does not move along the inner circumferential surface of the tub 30. In some implementations, the second flow 92 may clean the inside surface 14 of the door, the front and rear surfaces of the tub 30 and the drum 40, and the gasket 15.

The third flow 93 is a flow pattern in which wash water comes into tight contact with the inner circumferential surface of the tub 30 due to the centrifugal force generated from the wash water due to the movement of the wash water and is then pushed to the opposite ends of the tub 30. The third flow 93 may clean the gasket 15 and the lower part of the inside surface 14 of the door.

In some implementations, in order for the wash water to circulate or move along the inner circumferential surface of the tub 30 due to the rotational force of the drum 40, at least a portion of the outer circumferential surface of the drum 40 may contact the wash water. In this regard, wash water is supplied into the tub up to a predetermined water level.

Figure 3:
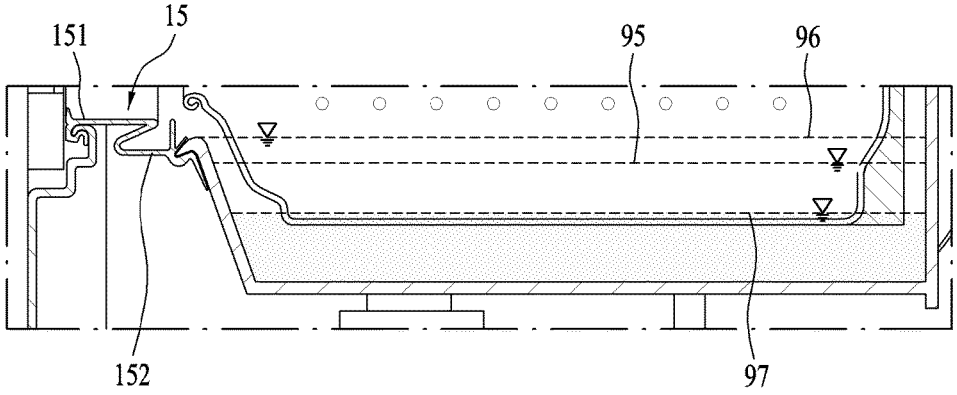
FIG. 3 is an enlarged view showing the part II of FIG. 1 and an example level of wash water.

The level of wash water will be described with reference to FIG. 3. FIG. 3 is an enlarged view showing the part II of FIG. 1 to describe the level of wash water.

Referring to FIG. 3, a predetermined level 95 of wash water is equal to or greater than at least the height from the lower end of the tub 30 to the lower end of the drum 40 (e.g., the minimum level 97). The reason for this is that wash water can flow due to friction between the drum 40 only when at least a portion of the drum 40 contacts the wash water.

In some examples, the predetermined level 95 of wash water may be set to be higher such that the user can directly check the flow of the wash water during the cleaning operation through the door 13. For example, the predetermined level 95 of wash water may be set to the extent that the user can visually check whether the tub 30 is being cleaned while viewing the interior of the drum 40 through the door 13.

In some cases, the predetermined level 95 of wash water does not have an upper limit. In other cases, the predetermined level 95 of wash water is set to be lower than a full water level 96. The full water level 96 is a level at which the tub 30 and the drum 40 are fully filled with wash water such that the wash water may overflow the gasket 15.

If the predetermined level 95 of wash water is set to the full water level 96, the wash water may be pushed to the door 13 and the wash water may leak. In some examples, frictional force between the drum 40 and the wash water may increase, noise and vibration may be caused, and the motor 51 may be overloaded.

The predetermined level of wash water, which was explained with respect to the washing machine 1 shown in FIGS. 1 to 3 that includes the shaft 55 that is parallel to the ground, may be applied to a tilted type washing machine 1 that includes the shaft 55 that is inclined at a predetermined angle with respect to the ground. In this case, the height of the front part of the drum immersed in the wash water and the height of the rear part of the drum immersed in the wash water may be different, since the front part of the drum 40 may be higher from the ground than the rear part of the drum 40. In some examples, the front part of the drum 40 is may be lower than the rear part of the drum 40 from the ground.

In some implementations, the input unit 19, which allows the user to input a command for cleaning the inner circumferential surface of the tub 30, may be further provided at the position where the control panel 17 is located. For example, a washing machine 1 may include a rotary knob or buttons provided on the control panel for allowing the user to input a command for operating the washing machine 1. In some examples, the input unit 19, which allows the user to input a command for cleaning the tub 30, may be provided at the rotary knob, or an additional button may be provided. The washing machine may be configured such that the tub 30 can also be cleaned when a conventional operation mode is input. The operation of cleaning the inner circumferential surface of the tub 30 may be performed by default or optionally.

Figure 4:
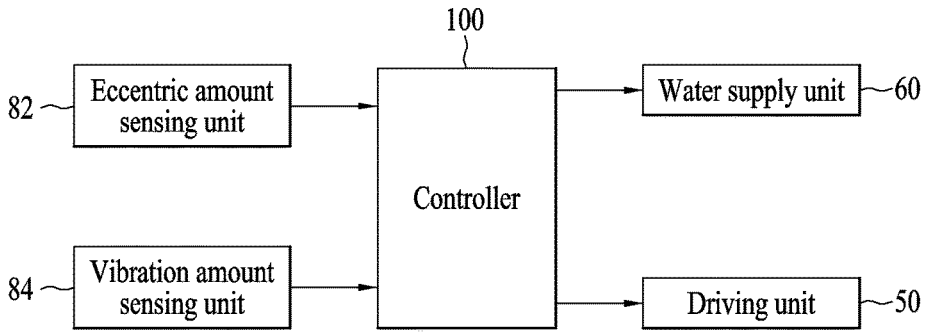
FIG. 4 is a block diagram showing an example control relationship between example main elements of the washing machine shown in FIG. 1.

Referring to FIG. 4, the washing machine includes an eccentric amount sensing unit 82, a vibration amount sensing unit 84, a water supply unit 60, a driving unit 50, and a controller 100, which are example elements for performing a control method, a description of which will follow. In the following description, the term "laundry" includes clothes.

The eccentric amount sensing unit 82 may sense an eccentricity or an eccentric amount of the drum 40. For example, the eccentric amount sensing unit 82 may sense the eccentric amount of the drum 40 based on variation in the rotational speed of the driving unit 50, which may change depending on distribution of laundry in the drum 40. In some examples, a speed sensing unit for sensing the rotational speed of the driving unit 50 may be provided separately from the driving unit 50. Alternatively, or in addition, an output current value of the driving unit 50 may be measured using a current sensing unit such as an encoder that is provided in the driving unit 50, and the eccentric amount may be sensed based on a change in the output current value. The eccentric amount sensing unit 82 transmits the sensed eccentric amount of the drum 40 to the controller 100 so that the controller 100 can control the water supply unit 60 or the driving unit 50.

The vibration amount sensing unit 84, which senses vibration generated during the rotation of the drum 40, may be provided separately from the eccentric amount sensing unit 82. The vibration amount sensing unit 84 may sense the vibration amount based on the displacement or vibration cycle of a mass body that moves according to vibration generated during the rotation of the drum 40. The vibration amount sensing unit 84 transmits the sensed vibration amount of the drum 40 to the controller 100 such that the controller 100 can control the water supply unit 60 or the driving unit 50.

The water supply unit 60 may supply water that contains detergent or clean water that contains no detergent into the tub 30.

The driving unit 50 provides driving force to rotate the drum 40. In this example, the driving unit 50 includes the motor 51 and the shaft 55 having one end connected to the motor 51 and the other end connected to the drum 40.

The controller 100 controls the driving unit 50 according to a signal input through the input unit or a process that is input in advance to perform a washing process including a washing cycle, a rinsing cycle, and a spin-drying cycle. During the washing process, the controller 100 continuously receives signals generated by the eccentric amount sensing unit 82 and the vibration amount sensing unit 84 to control the water supply unit 60 and the driving unit 50. In some examples, the controller 100 may control the display unit to display respective steps.

For example, the controller 100 controls the water supply unit 60 to set the level of wash water in the tub 30 and controls the driving unit 50 to set the rotational speed of the motor 51. The wash water supplied into the tub 30 may clean the inner circumferential surface of the tub 30 while being circulated along the inner circumferential surface of the tub 30 by the rotational force of the drum 40, and may clean the door 13 and the gasket 15 while dropping from the upper parts of the opposite ends of the tub 30.

Figure 5:
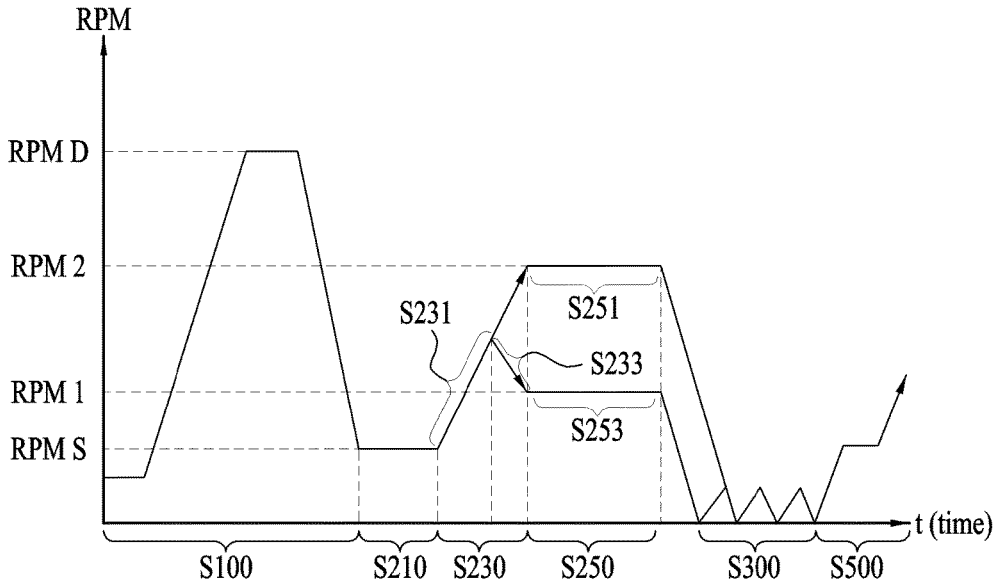
FIG. 5 is a graph showing an example change of the rotational speed of a drum over time.

Hereinafter, an example method of controlling the washing machine 1 will be described in detail with reference to FIG. 5. FIG. 5 is a graph showing an example change in the rotational speed of the drum 40 over time in a method of controlling a washing machine according to an implementation of the present disclosure.

FIG. 5 illustrates the method of controlling the washing machine which includes a spin-drying step (S100), a water supply step (S210), an acceleration step (S230), and a cleaning step (S250).

The spin-drying step (S100) is a step of rotating the drum 40 at a spin-drying RPM (RPM D) to remove moisture from laundry received in the drum 40. For example, a washing process includes a washing cycle, a rinsing cycle, and a spin-drying cycle. Each cycle may include a spin-drying step (S100) of removing moisture from laundry. That is, the spin-drying step (S100) may not necessarily belong to a specific cycle selected from among the washing cycle, the rinsing cycle, and the spin-drying cycle, but may belong to any cycle in order to improve efficiency. For example, the spin-drying step may be included in the washing cycle or the rinsing cycle.

An example where the spin-drying step (S100) is a spin drying step for washing that is performed at the last stage of the washing cycle, will be described.

The spin-drying step (S100) is a step at which the drum 40 is rotated at the spin-drying RPM (RPM D) for a predetermined time and then is decelerated to a water supply RPM (RPM S) to discharge, from the tub 30, the wash water containing detergent and the contaminants removed from the laundry. The drum 40 may be decelerated to the water supply RPM (RPM S) without being stopped while being rotated at the spin-drying RPM (RPM D). In order to smoothly discharge the wash water, the spin-drying step (S100) may be performed in a state in which the drainage pump 71 is on or activated.

When the spin-drying step (S100) is performed, the wash water containing the detergent is removed from the laundry in a state in which the laundry is in tight contact with the inner circumferential surface of the drum 40. In some examples, a considerable amount of detergent and contaminants of the laundry in the tub 30 is removed at the spin-drying step (S100). The water supply step (S210), the acceleration step (S230), and the cleaning step (S250) may be performed in a state in which the degree of contamination is relatively low or a considerable amount of detergent and contaminants has been removed.

The water supply step (S210) is performed after the spin-drying step (S100). The water supply step (S210) is a step of supplying wash water into the tub 30 from outside. At the water supply step (S210), the drum 40 is rotated at the water supply RPM (RPM S).

At the water supply step (S210), the drainage pump 71 may remain off or be deactivated until a predetermined time of a rinsing step (S300) of the rinsing cycle. The wash water supplied at the water supply step (S210) is not discharged from the tub while the cleaning step (S250) is performed such that the wash water can be used as rinsing water at the subsequent rinsing step (S300). At the rinsing step (S300), therefore, it is not necessary to further supply an amount of wash water corresponding to the amount of the wash water supplied at the water supply step (S210).

In some implementations, the rotation of the drum 40 is not stopped when the spin-drying step (S100) is switched to the water supply step (S210). For example, the drum 40 is decelerated to the water supply RPM (RPM S) at the end of the spin-drying step (S100) and then starts to rotate at the water supply RPM (RPM S) at the beginning of the water supply step (S210).

The water supply RPM (RPM S) may be defined as the minimum RPM at which the laundry moving along the drum 40 is prevented from being separated from the inner circumferential surface of the drum 40 due to centrifugal force. That is, when the drum 40 is rotated, a centrifugal force of 1G (e.g., acceleration of gravity) or higher may be applied to the laundry. The water supply RPM (RPM S), which is the rotational speed at which the laundry comes into tight contact with the inner circumferential surface of the drum 40, may range from about 60 to 110 RPM. However, the water supply RPM (RPM S) may be set to 108 RPM in consideration of the subsequent cleaning step (S250).

If the water supply RPM (RPM S) is too high, the pressure sensor 85, which measures the water level, may malfunction. That is, when the drum 40 is rotated at a high rotational speed, the level of the wash water at one side of the drum 40 rises, and the level of the wash water at the other side of the drum 40 drops. In the case in which the first drainage pipe 73 is connected to the side at which the level of the wash water rises, the water pressure applied to the first drainage pipe 73 increases with the rise in the water level. The force from the increased water pressure is applied to the air chamber 81 that is connected to the side surface of the first drainage pipe 73, whereby the pressure sensor 85 may sense a water level higher than the actual water level. In order to prevent the pressure sensor 85 from incorrectly sensing the water level, therefore, it may be necessary to set the water supply RPM (RPM S) to an RPM at which the water pressure increases due to the rotation of the drum 40.

At the water supply step (S210), wash water is supplied into the tub 30 up to a predetermined water level. As previously described, at the water supply step (S210), wash water is supplied such that the predetermined level of wash water is equal to or higher than the height from the lower end of the tub 30 to the lower end of the drum 40 (e.g., the minimum level). For instance, at the water supply step (S210), wash water may be supplied to the extent that the user can visually check whether the tub 30 is being cleaned while viewing the interior of the drum 40 through the door. The predetermined water level may be lower than a full water level or, for example, a water level at which the tub 30 and the drum 40 are fully filled with wash water such that the wash water may overflow the gasket.

In some implementations, laundry received in the drum 40 have different water content ratios depending on the kind of laundry. For example, when the spin-drying step (S100), at which moisture is removed from the laundry, is performed, the distribution of the moisture contained in the laundry in the drum 40 may be changed, and the eccentric amount of the drum 40 may be changed. In some examples, during the water supply step (S210), the laundry received in the drum 40 remains in tight contact with the inner circumferential surface of the drum 40. However, the distribution of the moisture contained in the laundry in the drum 40 may be partially changed due to the supply of wash water.

At the water supply step (S210), the eccentric amount of the drum may be sensed before the acceleration step (S230), at which the drum 40 is accelerated, is performed. An eccentricity is a phenomenon in which the laundry such as clothes is biased to one side of the drum 40 due to tangling of the laundry, in which one side of the drum 40 becomes heavier on the basis of the center of the drum 40, and an eccentric amount is the degree of eccentricity that is expressed as a value. When the drum 40 is rotated at a high speed in a state in which the laundry in the drum 40 is eccentric, for example, when the laundry is spin-dried, vibration and noise may be generated due to imbalance between the geometrical center of the axis of rotation of the drum 40 and the actual center of gravity of the drum 40.

When the eccentric amount sensed at the water supply step (S210) is equal to or less than a reference eccentric amount, the acceleration step (S230) may be performed. When the sensed eccentric amount is greater than the reference eccentric amount, the drainage pump 71 is turned on to drain the residual wash water from the tub 30. Subsequently, the water supply step (S210) is performed again to sense the eccentric amount. The above operation may be repeatedly performed until the sensed eccentric amount is equal to or less than the reference eccentric amount. However, if the above operation is performed too many times, energy consumption or power consumption may increase. In some examples, all steps may be finished or canceled if the above operation is repeated a predetermined number of times.

The acceleration step (S230) is a step that is performed between the water supply step (S210) and the cleaning step (S250). At the acceleration step (S230), the drum 40 is accelerated to perform the cleaning step (S250). At the acceleration step (S230), the eccentric amount of the drum 40 is sensed during the acceleration of the drum 40. The acceleration step (S230) includes a first acceleration step (S231) and a second acceleration step (S233). Although the eccentric amount of the drum 40 is described as being sensed during the acceleration of the drum 40, the present disclosure is not limited thereto. The vibration amount of the drum 40 may be sensed. The vibration amount of the drum 40 may depend on the eccentric amount of the drum 40. When the vibration amount of the drum 40 may be sensed, therefore, the eccentric amount of the drum 40 may also be sensed.

The first acceleration step (S231) is a step at which the eccentric amount of the drum 40 is sensed while the drum 40 is accelerated. When the sensed eccentric amount is not greater than the reference eccentric amount, the drum 40 is accelerated to a second RPM (RPM 2), which is the rotational speed of the drum 40 at a second cleaning step (S251), a description of which will follow. Subsequently, the second cleaning step (S251) is performed. When the sensed eccentric amount is greater than the reference eccentric amount, the first acceleration step (S231) is stopped at the time C at which the eccentric amount exceeds the reference eccentric amount, and the second acceleration step (S233) is performed.

At the second acceleration step (S233), the drum 40 is accelerated, but the eccentric amount of the drum 40 is not sensed. At the second acceleration step (S233), the drum 40 is accelerated to a first RPM (RPM 1), which is lower than the second RPM (RPM 2). Since the eccentric amount of the drum 40 is greater than the reference eccentric amount, the drum 40 may vibrate severely. For this reason, the first RPM (RPM 1) is set to be lower than the rotational speed of the drum 40 at the time C at which the eccentric amount exceeds the reference eccentric amount. In this case, the acceleration of the drum 40 at the second acceleration step (S233) has a negative value. Subsequently, a first cleaning step (S253) may be performed.

A success rate at the cleaning step (S250) may be higher than a conventional control method in which, when the eccentric amount exceeds the reference eccentric amount in the acceleration period, the rotation of the drum 40 is stopped, whereby the cleaning step (S250) is no longer performed.

The cleaning step (S250) is a step of rotating the drum 40 such that wash water cleans the inner circumferential surface of the tub 30 while being circulated along the inner circumferential surface of the tub 30 by the rotational force of the drum 40. At the cleaning step (S250), no wash water is supplied into the tub 30, and the drainage pump 71 remains off in order to prevent the discharge of wash water.

At the cleaning step (S250), wash water circulates according to the flow pattern that includes the first to third flows 91, 92, and 93 (see FIG. 2). The wash water circulating according to the flow pattern may be defined as a circulating current. According to the first to third flows 91, 92, and 93, the circulating current includes all flows of wash water circulating between the tub 30 and the drum 40 together with the flow of wash water moving along the inner circumferential surface of the tub 30. The inner circumferential surface of the tub 30, the outer circumferential surface of the drum 40, the gasket 15 and the inside surface 14 of the door are cleaned by the circulating current having the flow pattern.

In some examples, at the cleaning step (S250), the rotational speed of the drum 40 may be set to any of at least two rotational speeds depending on the eccentric amount sensed at the acceleration step (S230), as previously described. In this example, the rotational speed of the drum 40 is set to one of two rotational speeds.

The cleaning step (S250) includes a first cleaning step (S253), at which the rotational speed of the drum 40 is set to the first RPM (RPM 1) when the eccentric amount sensed at the acceleration step (S230) (e.g., the first acceleration step (S231)) is greater than the reference eccentric amount, and a second cleaning step (S251), at which the rotational speed of the drum 40 is set to the second RPM (RPM 2), which is higher than the first RPM (RPM 1), when the eccentric amount sensed at the acceleration step (S230) (e.g., the first acceleration step (S231)) is equal to or less than the reference eccentric amount.

The first cleaning step (S253) and the second cleaning step (S251) may be selectively performed. For example, only one step selected from the first cleaning step (S253) and the second cleaning step (S251) may be performed after the acceleration step (S230) depending on the eccentric amount of the drum 40.

The first cleaning step (S253) is a step at which the drum 40 is rotated at the first RPM (RPM 1), which is higher than the water supply RPM (RPM S), such that wash water forms a circulating current for cleaning the inner circumferential surface of the tub 30, the door 13, and the gasket 15 while being circulated along the inner circumferential surface of the tub 30 by the rotational force of the drum 40. Such a circulating current may not be formed when the drum 40 is only rotated at the water supply RPM (RPM S).

In some examples, the first RPM (RPM 1) of the first cleaning step (S253) is set to be lower than the resonance frequency of a transient period. For example, when the drum 40 is rotated in the transient period, resonance may occur in the washing machine 1, and the magnitudes of noise and vibration of the washing machine considerably increase because the eccentric amount of the drum 40 exceeds the reference eccentric amount. Such noise and vibration of the washing machine 1 make the user uncomfortable, and moreover disturb the acceleration of the drum 40.

The transient period may be defined as a predetermined RPM range including one or more resonance frequencies at which resonance may occur depending on the system of the washing machine 1. The transient period is a unique vibration characteristic that occurs depending on the system of the washing machine 1 when the system of the washing machine 1 is decided. The transient period is changed depending on the system of the washing machine 1. For example, the washing machine 1 may have a first transient period range of about 130 to 150 RPM and a second transient period range of about 150 to 180 RPM.

At the first cleaning step (S253), for example, the first RPM (RPM 1) is set to about 108 to 120 RPM, and the eccentric amount of the drum 40 is additionally sensed. Only when the sensed eccentric amount is equal to or less than the reference eccentric amount, the first cleaning step (S253) is performed. When the sensed eccentric amount exceeds the reference eccentric amount, the first cleaning step (S253) is finished.

As described above, the second cleaning step (S251) and the first cleaning step (S253) may be selectively performed. The second cleaning step (S251) is a step at which the drum 40 is rotated at the second RPM (RPM 2), which is higher than the first RPM (RPM 1), such that the wash water forms the circulating current. The second RPM (RPM 2) is set to about 180 RPM, which is higher than the resonance frequency of the transient period.

At the second cleaning step (S251), the eccentric amount of the drum 40 may be sensed while the drum 40 is rotated at the second RPM (RPM 2). When the eccentric amount sensed at the acceleration step (S230) does not exceed the reference eccentric amount, however, the eccentric amount of the drum 40 is not greatly changed in most cases. Consequently, the eccentric amount of the drum 40 may not be sensed in order to reduce the time necessary to clean the tub 30.

When the cleaning step (S250) is finished, the drum 40 is no longer rotated, and is stopped. Subsequently, a rinsing cycle including a rinsing step (S300) is performed.

Additional supply of water may be performed for the rinsing cycle. Such additional supply of water is performed in order to supply an amount of wash water determined by subtracting the amount of wash water supplied at the water supply step (S210) from the amount of wash water necessary to perform the rinsing cycle. Even when wash water is supplied at the water supply step (S210), therefore, only the amount of wash water obtained by subtracting the supplied amount of wash water from the amount of wash water necessary to perform the rinsing cycle is additionally supplied at the subsequent rinsing cycle. In this case, a larger amount of wash water may not be used to perform the cleaning step (S250).

When the rinsing cycle including the rinsing step (S300) is finished, a spin-drying cycle including a spin-drying step (S500) is performed.

In some implementations, the method of controlling the washing machine 1 may further include a course recognition step of recognizing at least one from among a plurality of courses including the cleaning step (S250) of cleaning the tub 30. At the course recognition step, various washing courses for performing washing may be selected.

The user may perform manipulation through the input unit provided at the position at which the control panel is located such that the cleaning step (S250) is performed by default or optionally. For example, if the user does not select the cleaning step (S250), the cleaning step (S250) may be performed by default as described above. When the user selects the cleaning step (S250) through the input unit so that the cleaning step (S250) is optionally performed, the cleaning step (S250) may be recognized at the course recognition step, and control may be performed such that the cleaning step (S250) is performed immediately before the rinsing cycle is finished. In the case in which the user selects the cleaning step (S250) such that the cleaning step (S250) is performed optionally, improved effects due to the execution of the cleaning step (S250) are expected. Consequently, control may be performed such that the cleaning step (S250) is performed after contaminants are removed from the tub 30 through the execution of at least one rinsing step (S300).

Figure 6:
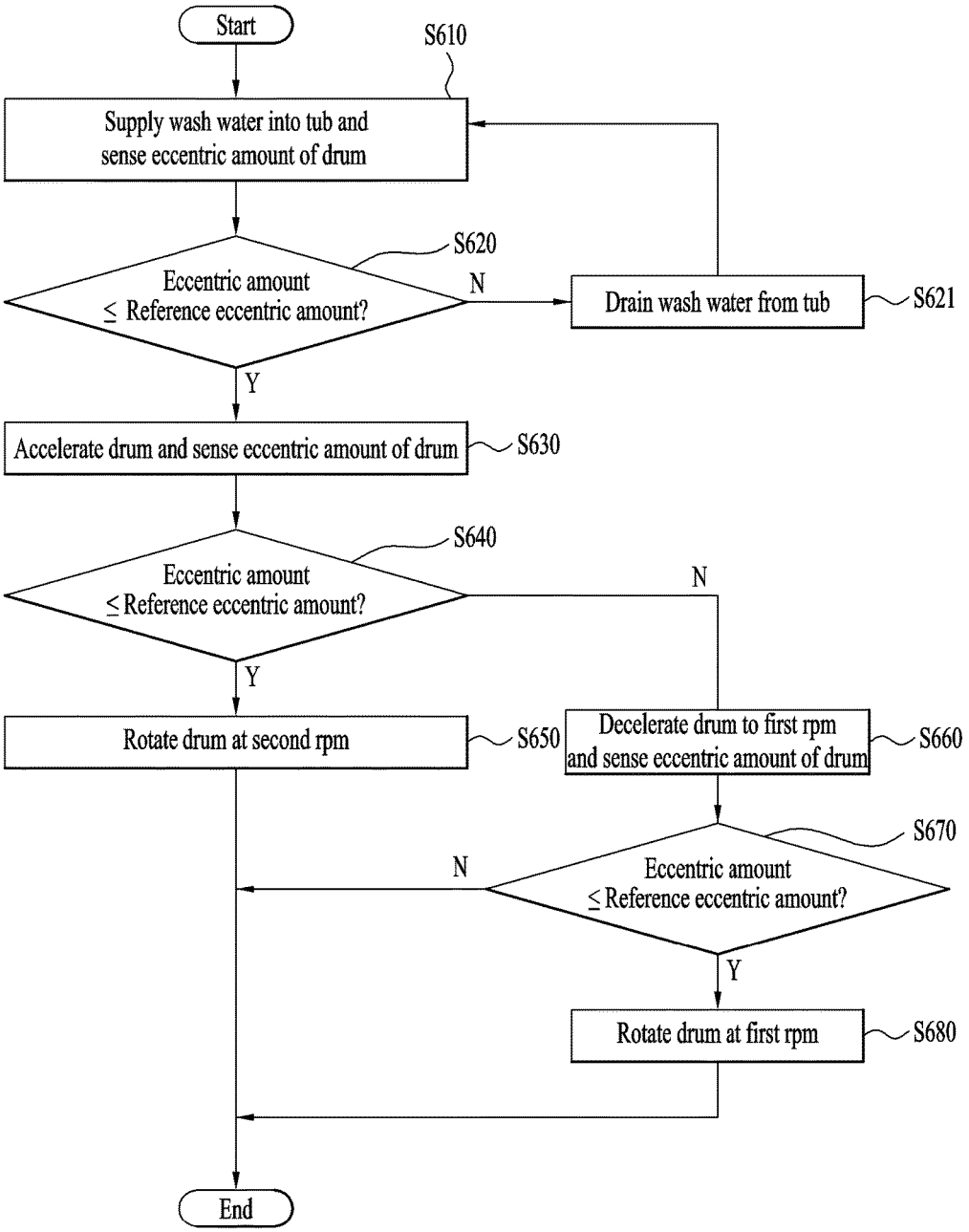
FIG. 6 is a flowchart showing an example method of controlling an example washing machine.

The steps of a method of controlling the washing machine will be described in detail with reference to FIG. 6. FIG. 6 is a flowchart showing the example method of controlling the washing machine. In the method of controlling the washing machine shown in FIG. 6, the spin-drying step (S100) is omitted.

Referring to FIG. 6, first, the eccentric amount of the drum 40 is sensed while wash water is supplied during the rotation of the drum 40 at the water supply RPM (RPM S) (S610).

When the eccentric amount sensed while the drum 40 is rotated at the water supply RPM does not exceed the reference eccentric amount (S620-Y), the eccentric amount of the drum 40 is continuously sensed while the drum 40 is accelerated (S630).

When the eccentric amount sensed while the drum 40 is rotated at the water supply RPM exceeds the reference eccentric amount (S620-N), all of the wash water is drained from the tub 30 (S621), the drum 40 is rotated at the water supply RPM, and the eccentric amount of the drum 40 is sensed while wash water is supplied (S610).

When the eccentric amount of the accelerated drum 40 does not exceed the reference eccentric amount (S640-Y), the drum 40 is rotated at the second RPM (RPM 2) (S650). Subsequently, the cleaning step (S250) is finished after the lapse of a predetermined time.

When the eccentric amount of the accelerated drum 40 exceeds the reference eccentric amount (S640-N), the drum 40 is decelerated to the first RPM (RPM 1) and the eccentric amount of the drum 40 is sensed while the drum 40 is rotated (S660).

When the eccentric amount of the drum 40 rotating at the first RPM (RPM 1) does not exceed the reference eccentric amount (S670-Y), the drum 40 is continuously rotated at the first RPM (RPM 1) (S680). Subsequently, the cleaning step (S250) is finished after the lapse of a predetermined time.

When the eccentric amount of the drum 40 rotating at the first RPM (RPM 1) exceeds the reference eccentric amount (S670-N), the rotation of the drum 40 is stopped, and the cleaning step (S250) is finished.

As is apparent from the above description, the washing machine according to the present disclosure has the following effects.

First, it may be possible to remove contaminants or scales from the inner circumferential surface of the tub and the outer circumferential surface of the drum.

Second, it may be possible to easily clean the tub without using an additional tub cleaning device.

Third, it may be possible to clean the tub at a high success rate.

Fourth, it may not be necessary to use any special detergent for tub cleaning. In some implementations, it may be possible to effectively clean the tub using a small amount of detergent to clean the tub in an environmentally friendly manner.

Fifth, it may be possible to clean the inside surface of the door and the gasket simultaneously with the cleaning of the inner circumferential surface of the tub and the outer circumferential surface of the drum.

Although the exemplary implementations have been illustrated and described as above, it will be apparent to those skilled in the art that the implementations are provided to assist understanding of the present disclosure and the present disclosure is not limited to the above described particular implementations, and various modifications and variations can be made from the present disclosure without departing from the spirit or scope of the present disclosure, and the modifications and variations should not be understood individually from the viewpoint or scope of the present disclosure.

What is claimed is:

1. A method for controlling a washing machine configured to receive laundry and including a tub and a drum located in the tub, the method comprising:

supplying wash water to the tub while rotating the drum at a water supply revolutions per minute (RPM);

accelerating rotation of the drum after supplying wash water to the tub, wherein accelerating rotation of the drum comprises:

sensing a first eccentric value of the drum while accelerating the rotation of the drum, and based on the first eccentric value, determining a rotational speed of the drum for cleaning the tub; and performing a cleaning operation of the tub, wherein the cleaning operation comprises rotating the drum at the rotational speed to clean an inner circumferential surface of the tub to cause circulation of wash water along the inner circumferential surface of the tub based on rotational force of the drum rotating at the rotational speed, wherein determining the rotational speed for rotating the drum comprises:

setting the rotational speed of the drum to a first RPM based on the first eccentric value exceeding a reference eccentric value, and setting the rotational speed of the drum to a second RPM greater than the first RPM based on the first eccentric value being less than or equal to the reference eccentric value.

2. The method according to claim 1, wherein accelerating rotation of the drum further comprises:

accelerating the rotational speed of the drum while sensing the first eccentric value of the drum, wherein accelerating the rotational speed of the drum comprises accelerating the rotational speed of the drum to the second RPM based on the first eccentric value being less than or equal to the reference eccentric value; and based on the first eccentric value exceeding the reference eccentric value, decelerating the rotational speed of the drum to the first RPM.

3. The method according to claim 2, wherein the first RPM is a rate greater than the water supply RPM and less than a resonance frequency of the washing machine.

4. The method according to claim 3, wherein the second RPM is a rate greater than the resonance frequency of the washing machine.

5. The method according to claim 2, wherein the cleaning operation comprises:

a first cleaning operation comprising rotating the drum at the first RPM based on decelerating the rotational speed of the drum to the first RPM; and a second cleaning operation comprising rotating the drum at the second RPM based on accelerating the rotational speed of the drum to the second RPM, and wherein performing the cleaning operation of the tub comprises selectively performing the first cleaning operation or the second cleaning operation based on the first eccentric value.

6. The method according to claim 5, further comprising:

sensing a second eccentric value of the drum based on rotating the drum at the first RPM; and stopping rotation of the drum at the first RPM based on the second eccentric value of the drum exceeding the reference eccentric value.

7. The method according to claim 1, further comprising:

sensing an initial eccentric value based on rotating the drum at the water supply RPM; and determining the rotational speed based on the initial eccentric value, wherein accelerating the rotation of the drum comprises accelerating the rotation of the drum based on the initial eccentric value.

8. The method according to claim 1, wherein rotating the drum at the water supply RPM comprises rotating the drum at a minimum RPM, in which the laundry maintains contact with an inner circumferential surface of the drum based on the laundry rotating together with the drum at the minimum RPM.

9. The method according to claim 1, wherein supplying the wash water to the tub comprises supplying the wash water to the tub to a predetermined water level based on a drainage pump connected to the tub being turned off.

10. The method according to claim 9, wherein rotating the drum at the rotational speed comprises rotating the drum based on the drainage pump being turned off.

11. The method according to claim 9, wherein the predetermined water level is greater than or equal to a water level defined between a lower end of the tub and a lower end of the drum.

12. The method according to claim 1, further comprising:

spin-drying laundry received in the drum before supplying water to the tub, wherein spin-drying laundry comprises accelerating rotation of the drum to a spin-drying RPM to remove moisture from laundry received in the drum; and based on completion of spin-drying, decelerating rotation of the drum from the spin-drying RPM to the water supply RPM.

13. The method according to claim 1, wherein setting the rotational speed of the drum to the first RPM comprises:

comparing the first eccentric value to the reference eccentric value;

based on the comparison of the first eccentric value to the reference eccentric value, determining that the first eccentric value exceeds the reference eccentric value; and based on determining that the first eccentric value exceeds the reference eccentric value, setting the rotational speed of the drum to the first RPM, and wherein setting the rotational speed of the drum to the second RPM comprises:

comparing the first eccentric value to the reference eccentric value;

based on the comparison of the first eccentric value to the reference eccentric value, determining that the first eccentric value is less than or equal to the reference eccentric value; and based on determining that the first eccentric value is less than or equal to the reference eccentric value, setting the rotational speed of the drum to the second RPM.

14. A method of controlling a washing machine configured to receive laundry and including a tub and a drum located in the tub, the method comprising:

rotating the drum at a water supply revolutions per minute (RPM);

supplying wash water to the tub based on rotating the drum at the water supply RPM;

accelerating rotation of the drum based on supplying the wash water to the tub;

sensing a first eccentric value of the drum based on accelerating the rotation of the drum;

based on the first eccentric value exceeding a reference eccentric value, decelerating a rotational speed of the drum to a first RPM;

based on the first eccentric value being less than or equal to the reference eccentric value, accelerating the rotational speed of the drum to a second RPM greater than the first RPM; and rotating the drum at the first RPM or the second RPM to cause circulation of wash water along an inner circumferential surface of the tub based on rotational force of the drum.

15. The method according to claim 14, wherein the first RPM is a rate greater than the water supply RPM and less than a resonance frequency of the washing machine, and wherein the second RPM is a rate greater than the resonance frequency of the washing machine.

16. The method according to claim 15, further comprising:

sensing an initial eccentric value based on rotating the drum at the water supply RPM;

based on the initial eccentric value exceeding the reference eccentric value, rotating the drum at the first RPM; and based on the initial eccentric value being less than or equal to the reference eccentric value, rotating the drum at the second RPM, wherein accelerating the rotation of the drum comprises accelerating the rotation of the drum based on the initial eccentric value.

17. The method according to claim 15, wherein the first RPM is a rate between 130 and 150 revolutions per minute, and wherein the second RPM is a rate between 150 and 180 revolutions per minute.

18. The method according to claim 14, further comprising drying laundry received in the drum by rotating the drum at a spin-drying RPM that is a rate greater than the first RPM and the second RPM.

19. The method according to claim 14, further comprising:

spin-drying laundry received in the drum before supplying water to the tub, wherein spin-drying laundry comprises accelerating rotation of the drum to a spin-drying RPM to remove moisture from laundry received in the drum; and based on completion of spin-drying, decelerating rotation of the drum from the spin-drying RPM to the water supply RPM.

20. The method according to claim 14, wherein decelerating the rotational speed of the drum to the first RPM comprises:

comparing the first eccentric value to the reference eccentric value;

based on the comparison of the first eccentric value to the reference eccentric value, determining that the first eccentric value exceeds the reference eccentric value; and based on determining that the first eccentric value exceeds the reference eccentric value, decelerating the rotational speed of the drum to the first RPM, and wherein accelerating the rotational speed of the drum to the second RPM comprises:

comparing the first eccentric value to the reference eccentric value;

based on the comparison of the first eccentric value to the reference eccentric value, determining that the first eccentric value is less than or equal to the reference eccentric value; and based on determining that the first eccentric value is less than or equal to the reference eccentric value, accelerating the rotational speed of the drum to the second RPM.

* * * * *